US006595459B2

(12) United States Patent
Hanson

(10) Patent No.: US 6,595,459 B2
(45) Date of Patent: Jul. 22, 2003

(54) APPARATUS AND PROCESS FOR WINDING WEBBED MATERIAL UPON CORES

(75) Inventor: John R. Hanson, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 27 days.

(21) Appl. No.: 09/774,274

(22) Filed: Jan. 30, 2001

(65) Prior Publication Data

US 2002/0100832 A1 Aug. 1, 2002

(51) Int. Cl.[7] ..... B65H 19/28

(52) U.S. Cl. ..... 242/532.3; 242/533; 242/533.7; 242/541; 242/542.3

(58) Field of Search ..... 242/532.3, 533, 242/533.1, 533.7, 541, 542.3, 541.1, 547

(56) References Cited

U.S. PATENT DOCUMENTS

| | | | | |
|---|---|---|---|---|
| 3,847,366 A | | 11/1974 | Schmidt et al. | |
| 3,995,747 A | * | 12/1976 | Lewey et al. | 242/533.7 |
| 4,103,840 A | | 8/1978 | Dowd | |
| 4,133,495 A | | 1/1979 | Dowd | |
| 4,177,410 A | | 12/1979 | Dowd | |
| 4,191,341 A | | 3/1980 | Looser | |
| 4,204,650 A | | 5/1980 | Mengel | |
| 4,512,528 A | * | 4/1985 | Kuhn | 242/533 |
| 4,583,698 A | | 4/1986 | Baroffio et al. | |
| 4,723,724 A | * | 2/1988 | Bradley | 242/532.3 |
| 4,757,951 A | | 7/1988 | Ludszeweit | |
| 4,856,725 A | * | 8/1989 | Bradley | 242/532.3 |
| 5,005,274 A | | 4/1991 | Timell | |
| 5,054,708 A | | 10/1991 | Wiggers | |
| 5,421,536 A | | 6/1995 | Hertel et al. | |
| 5,542,622 A | | 8/1996 | Biagiotti | |
| 5,653,401 A | | 8/1997 | Biagiotti | |
| 5,681,421 A | * | 10/1997 | Biagiotti | 242/532.3 |
| 5,690,297 A | | 11/1997 | McNeil et al. | |
| 5,769,352 A | | 6/1998 | Biagiotti | |
| 5,810,282 A | | 9/1998 | McNeil et al. | |
| 5,853,140 A | | 12/1998 | Biagiotti | |
| 5,924,273 A | | 7/1999 | Bertrams et al. | |
| 6,050,519 A | | 4/2000 | Biagiotti | |
| 6,056,229 A | * | 5/2000 | Blume et al. | 242/532.3 |
| 6,142,407 A | | 11/2000 | McNeil et al. | |

OTHER PUBLICATIONS

PCT International Search Report for PCT/US02/02397, Oct. 7, 2002.

* cited by examiner

*Primary Examiner*—William A. Rivera
(74) *Attorney, Agent, or Firm*—Dority & Manning, P.A.

(57) ABSTRACT

A system for winding webbed material such as paper toweling or toilet tissue upon a core is disclosed. The system comprises apparatus and processing steps. A plurality of elongated mandrels are adapted to receive cores slipped over their outer surface. Furthermore, a first conveyor having a drive device for moving mandrels in series along a drive train is provided. At least the first end of said mandrel is adapted for engaging the drive means. Further, a mandrel transfer station comprising a receiving mechanism for accepting cored mandrels is capable of winding webbed material upon the cored mandrel in a continuous process. A driving force is applied to at least the first end of said cored mandrel, thereby forming logs of webbed material. In some embodiments of the disclosure, a belt and pulley system is used to convey cored mandrels along an assembly line in a longitudinal manufacturing process.

34 Claims, 9 Drawing Sheets

APPARATUS AND PROCESS FOR WINDING WEBBED MATERIAL UPON CORES

BACKGROUND OF THE INVENTION

Several methods of winding webbed material such as paper products upon cores have been used in the papermaking industry. Toilet tissue, paper towels, wipers, and the like are manufactured by first producing a webbed material, and then in a subsequent step winding (or rewinding) the webbed material upon cores for consumer use. One common method of transferring such material to cores is referred to as surface winding. A second common method is known as center winding.

There are many known types of rewinders which are based upon the principle of surface winding. The finished products are sometimes referred to as rolls or logs. In general, automatic surface rewinders comprise those rewinding systems in which logs are formed automatically in rapid succession. In surface rewinding, the log in the process of formation is rotated by surface contact of the roll with an external system of belts or rollers. Some known examples of surface winding apparatus and techniques are shown in U.S. Pat. Nos. 4,723,724; 6,050,519; 5,542,622; 5,853,140; 5,769,352; and 4,856,725.

In general, the process of surface rewinding produces a high number of rolls per unit time, and such finished rolls, when finished, are discharged to the exterior of the rewinder and collected in a sorter or intermediate storage receiver. Then, the free tail edge of the webbed material is glued onto the log to prevent unwinding of the end portion of the roll prior to cutting the log into smaller rolls for packaging.

Surface rewinding is a common method of rewinding paper products such as toilet tissue, paper towels, wipers, and other webbed materials upon finished logs for consumer use.

Another common method of rewinding rolls is by way of a process termed center winding. In general, center winding is accomplished using a web winding apparatus that includes a turret assembly, a core loading apparatus and a finished log stripping apparatus. Examples of such apparatus are shown in U.S. Pat. Nos. 5,690,297 and 5,810,282. In typical center winding processes, a turret assembly supports one or more rotating mandrels adapted for engaging hollow cores upon which a paper web is to be wound. Each mandrel is driven in a closed mandrel path, or processing loop, which may follow either a non-circular or circular pathway. In general, the turret assembly may be rotated continuously, and the web length per wound log is changed as the turret assembly is rotating. Usually, but not always, each step of the cycle occurs simultaneously. The turret cannot rotate to the next stage of processing until the steps at each active stage of the turret have been fully completed.

Typical center winding systems include several cycle positions including: (1) a loading position (for loading cores upon the mandrel), (2) a glue position (for applying glue to the core), (3) pre-spin position (for bringing a cored mandrel up to winding speed); (4) a transfer position (in which the web or paper is transferred to the spinning core at high speed); (5) a tail scaling position where adhesive is applied to the log or last sheet (for scaling the end); and (6) a log stripping position (in which the wound log is removed from the mandrel). In center winding operations, one respective step occurs at each position during the process, simultaneously.

In center winding apparatus, a disadvantage is that the rate determining step (i.e. the slowest step in the process) determines or fixes the speed at which the entire operation may progress. That is, even if a core may be loaded onto a mandrel in a very short period of time, or the gluing of paper upon the core may occur very quickly, the speed of the entire process can proceed no faster than the slowest step in the closed loop cycle. Thus, the slowest step (i.e., the step that takes the largest amount of elapsed time) will be the rate determining step which prevents the overall manufacturing process from producing a greater number of finished logs per unit time.

There are significant disadvantages to surface winding operations as well. One significant disadvantage of surface winding operations is that webbed products (such as toilet tissue or kitchen towels) which are very soft in texture and/or low in density cannot be reliably wound using high speed surface winding techniques. Rolls that contact the surface of the partially wound roll, i.e. the "rider rolls", must apply pressure to the exterior surface of the log in a precise manner, which leaves little room for tolerance or "play" in the system. Low density logs do not possess the structural integrity necessary to resist surface winding forces without suffering plastic deformation and/or excessive log oscillation during rewind. Thus, surface rewinding is sometimes difficult in the case of soft, low density compressible webbed products, such as soft grades of toilet tissue and thick paper towels.

What is needed in the industry is a method and winding apparatus that facilitates faster rates of operation, for any type of webbed material, soft or otherwise. That is, a method that is capable of removing the influence of log cycle rate as a speed limitation, would be useful. A method which can employ mandrels in a more efficient manner, that facilitates the pre-loading of mandrels with cores in a process that is not directly time dependent upon the rewinding or the cores would be very desirable. That is, a system and apparatus that is capable of combining the advantages of center winding with the advantages of surface winding, while at the same time removing some of the limitations of each winding method, would be very desirable. An apparatus and method that is capable of rewinding rolls of any density and web length at a faster rate, in a more reliable manner, is desired.

SUMMARY OF THE INVENTION

An efficient system for winding webbed material upon a cored mandrel is provided. The system includes an elongated mandrel, the mandrel being adapted to receive a core upon its outer surface. Such cored mandrels of various quantities are provided in a holding or retention area, and then brought forth independently when needed in the process of winding webbed material into logs or rolls.

A first conveyor having a drive means for moving mandrels longitudinally along a drive train is provided. Rather than moving in a circular fashion or closed loop, the cored mandrels are collected and distributed to the process at the time they are needed. In most cases, the mandrels move in sequence, one after another, wherein at least the first end of said mandrel is adapted for engaging a drive means at appropriate times in the process.

A mandrel transfer station comprises a receiving mechanism for accepting cored mandrels, wherein the transfer station provides a means for winding webbed material upon said cored mandrel in a continuous process by applying a driving force to at least the first end of said cored mandrel to rotate the mandrel, thereby forming logs of webbed material. In some applications, the invention further comprises a gripping means applied to a first end of the mandrel to remove the mandrel from a drive train. In some applications of the invention, a log removal station is provided to remove logs of paper or tissue from said mandrels. A second conveyor may be adapted to move mandrels from a log removal station to a mandrel retention area.

In another application of the invention, a system is disclosed for winding webbed material upon cores in a continuous process. First, a plurality of elongated cylindrical mandrels are adapted to receive cores on their outer surface, the mandrels each having a first end and a second end. The cores have a circumferential surface on their outer periphery. A mandrel loading station is adapted for receiving a plurality of individual mandrels and loading the mandrels with cores to form cored mandrels. Then, a first conveyor with a drive assembly moves cored mandrels in a line along a drive train by engaging one or both ends of the cored mandrel with a drive. An adhesive application station is configured for placing adhesive at a specific predetermined circumferential location on the outer periphery of the core of the cored mandrels. A mandrel transfer station comprises a receiving means for accepting cored mandrels. The transfer station provides a means for winding webbed material upon the cored mandrels in a continuous process by applying a driving force to at least the first end of said cored mandrels. Cored logs of webbed material are formed, and ultimately may be cut into separate rolls of paper products.

In some applications of the invention, a belt and pulley system is used. The mandrel transfer station comprises a standard bedroll being configured to release said webbed material to a first cored mandrel once the first mandrel reaches the transfer position. The webbed material may be released by applying a driving force to at least the first end of the first cored mandrel, thereby pulling webbed material from the bedroll and forming a cored log of webbed material as the mandrel exits the transfer position and reaches a winding station. Also, at the same time, a second cored mandrel is pulled into the transfer position by a belt and pulley system.

In one aspect of the invention, an adhesive is placed longitudinally along the length of the cored mandrel at a specific circumferential location on the core, wherein the registration of the core with the drive means facilitates the subsequent placement of webbed material at a specific location upon the outer periphery of the core. This process enables adhesion of the webbed material to the core at a predetermined and specific location that uses a minimum amount of adhesive placed at precisely the location in which the glue is needed. The system is designed to reduce cost, increase production output, and avoid excess waste of adhesive.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
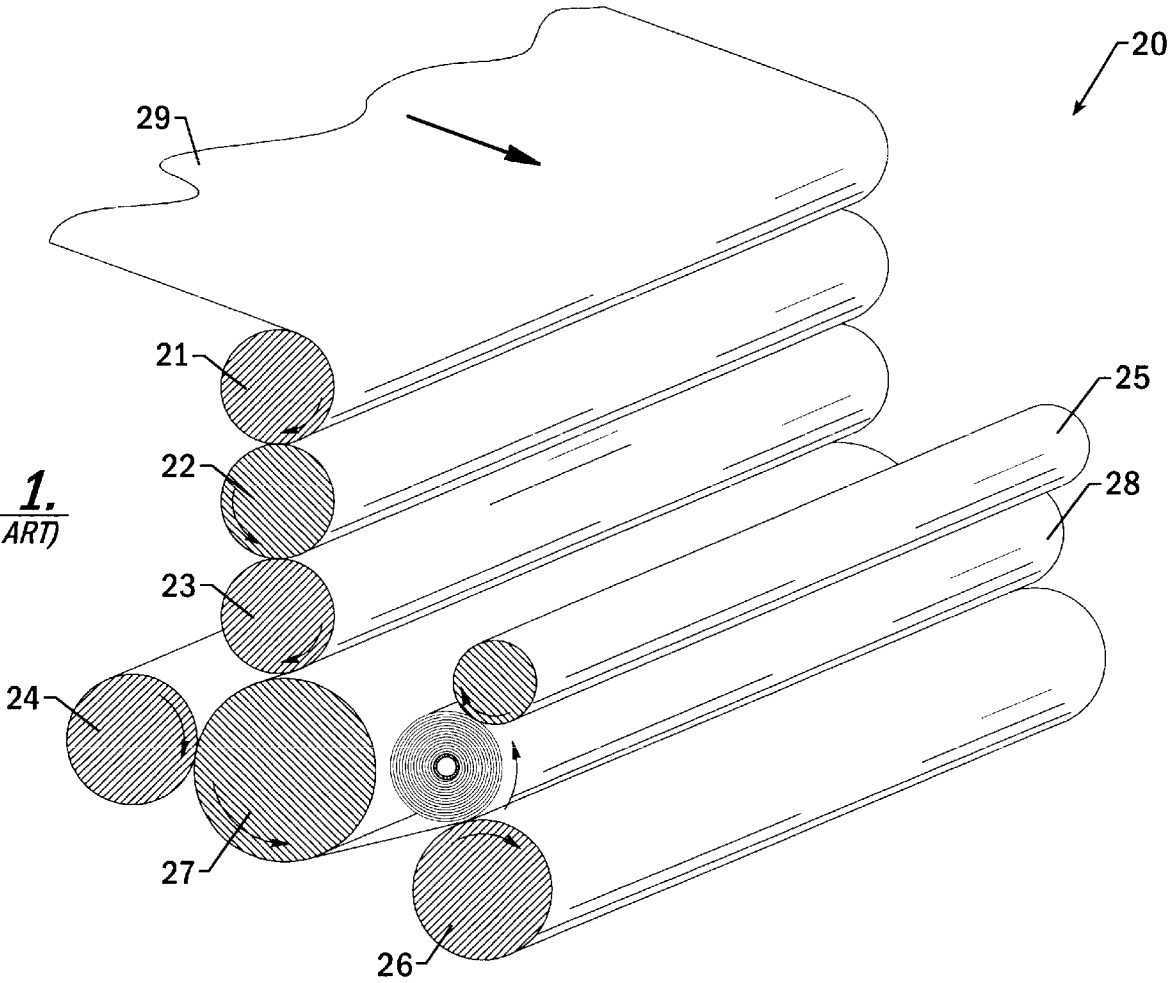
FIG. 1. (PRIOR ART)
FIG. 1 is a perspective view of a prior art surface rewinding system showing a typical set-up for rewinding a webbed material upon a core.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

In the invention, a center driven rewinder without a closed loop turret is capable of avoiding the normally accepted process delays of loading cores onto mandrels and stripping wound logs from the mandrels. Thus, invention facilitates faster rates of operation for rewinding apparatus (especially for roll lengths which are less than about 100 ft.) by employing the most desirable advantages of both surface and center winding. In most cases, the influence of log cycle rate may be separated from the speed limitation of a center driven rewinder by preloading the mandrels with cores externally from the winding process. Thus, wound logs may be stripped from mandrels externally (i.e. independent of the winder) while other cores are receiving a transfer of webbed material.

In the invention, numerous mandrels are used. Several winding mandrels are stored in a queue region near a rewinder section of the apparatus. Core material is loaded onto the mandrels in the queue area prior to the cored mandrels being used in the rewind process. For purposes of this specification, a mandrel which has a core applied to its outer surface is deemed a "cored mandrel".

A cored mandrel may be advanced by mechanical means such as a conveyor, cam track, or rocker arm lifter into a section of the machine wherein a "transfer" or "pick-up" adhesive glue is applied to the core. This glue is necessary in order to provide a location for the tissue or paper product to be glued or otherwise attached to the core, and then the paper may be wound upon the core. The glue or adhesive may be applied either rotationally or axially in the practice of the invention. However, as further described below, the speed of the overall process sometimes may be increased by applying glue axially or longitudinally in a line or pathway along the length of the core, and not applying glue to the entire exterior circumference of the core as has been the practice in many prior art methods. This will be discussed below in connection with FIG. 7. Furthermore, less glue can be used by practicing the invention, resulting in cost savings as compared to the prior art. Further, it is possible in many cases to avoid the undesirable spinning of cores having received an excess of glue, which may sometimes splatter glue, causing maintenance and clean-up problems.

In the invention, a pre-loaded mandrel (i.e. a cored mandrel), when ready, is advanced into the rewind section by mechanical means such as a conveyor, cam track, rocker arm lifter, or other suitable apparatus. Then, the cored mandrel is rotated about its axis by torsion applied at one or each end of the mandrel. In one application of the invention, a belt and pulley system may be used to apply torsion to the cored mandrel. In general, the drive torsion may be applied by various methods including, but not limited to, gearing or pulleys, rotational surface friction, magnetic flux, and other means known by persons of skill in the art.

In the practice of the invention, a moving web is transferred from an existing winding log to a new core as the core rotates, by mechanical means such as a standard bed roll. The mandrel is rotated at changing rotational velocity so that the web speed and the winding profile may be controlled as the log builds. In most cases, the axial position of the mandrel may change gradually by mechanical means such as conveyor or timing belt drive speed changes, cam track, or a rocker arm as the log diameter increases to minimize web interference with machine components during winding. Then, when the desired length of webbed material has been wound upon the cored mandrel into a finished log, the web is severed and transferred to another incoming cored mandrel by standard bed roll means and the process begins once again on the next successive cored mandrel.

In the practice of the invention, the wound log may be advanced to another section of the machine by mechanical means such as conveyor or timing belt drive speed changes, cam track, or rocker arm lifter wherein the log is stripped from the mandrel and forwarded to downstream processes for cutting and packaging. The bare mandrel is then returned to the queue area where it awaits application of another core. In some applications, the mandrels will accumulate in a mandrel storage area, while in other applications the mandrels may be carried by a recycle loop back to a point at which they are reinserted into the line of the rewinding process. In general, the processes and apparatus of the invention may be used for any rewound web, including bath tissue, facial tissue, paper towels, or any other rolled web product.

The process of the invention may circumvent the need for a closed mandrel path, which is a significant advantage over conventional center winding processes. In the practice of the invention it is possible to advance a rotational mechanism (in this case a pre-loaded cored mandrel instead of a bare core) from an open path into the rewind nip or transfer area for the purpose of winding the web. The path of the mandrel is independent of the core loading and log stripping operations, and therefore there is no cycle rate limit associated with the rewind process in the practice of the invention. One advantage of the invention over prior art methods and apparatus is that the machine speed which may be obtained using the invention is not limited by the cycle rate for wound web lengths. This is especially true for wound web lengths which are less than about 100 ft. The reason for this (100 ft.) "threshold" is that best available typical centerwind technology is limited to 30 logs per minute and/or 3,000 feet per minute. Using this invention, 3,000 feet per minute is still achievable when wound webs are less than 100 feet because there is no 30 logs per minute cycle rate limit.

Turning to FIG. 1, a typical prior art surface rewinding system 20 is shown having a draw roll 21 and a draw roll 22. A sheet or web 29 is provided over the draw rolls 21 and 22 and driven across the perf roll 23 and past an upper winding roll 27. A chopper roll 24 is shown in FIG. 1, and a rider roll 25 is pressed against the paper log 28 during formation of the paper log 28. A lower winding roll 26 (decell roll) is also provided against the paper log 28. In general, the upper winding roll 27 and the lower winding roll 26 provide the surface force upon the paper log 28 that spins the paper log 28, allowing it to take up the sheet 29 from the upper winding roll 27.

Figure 2:
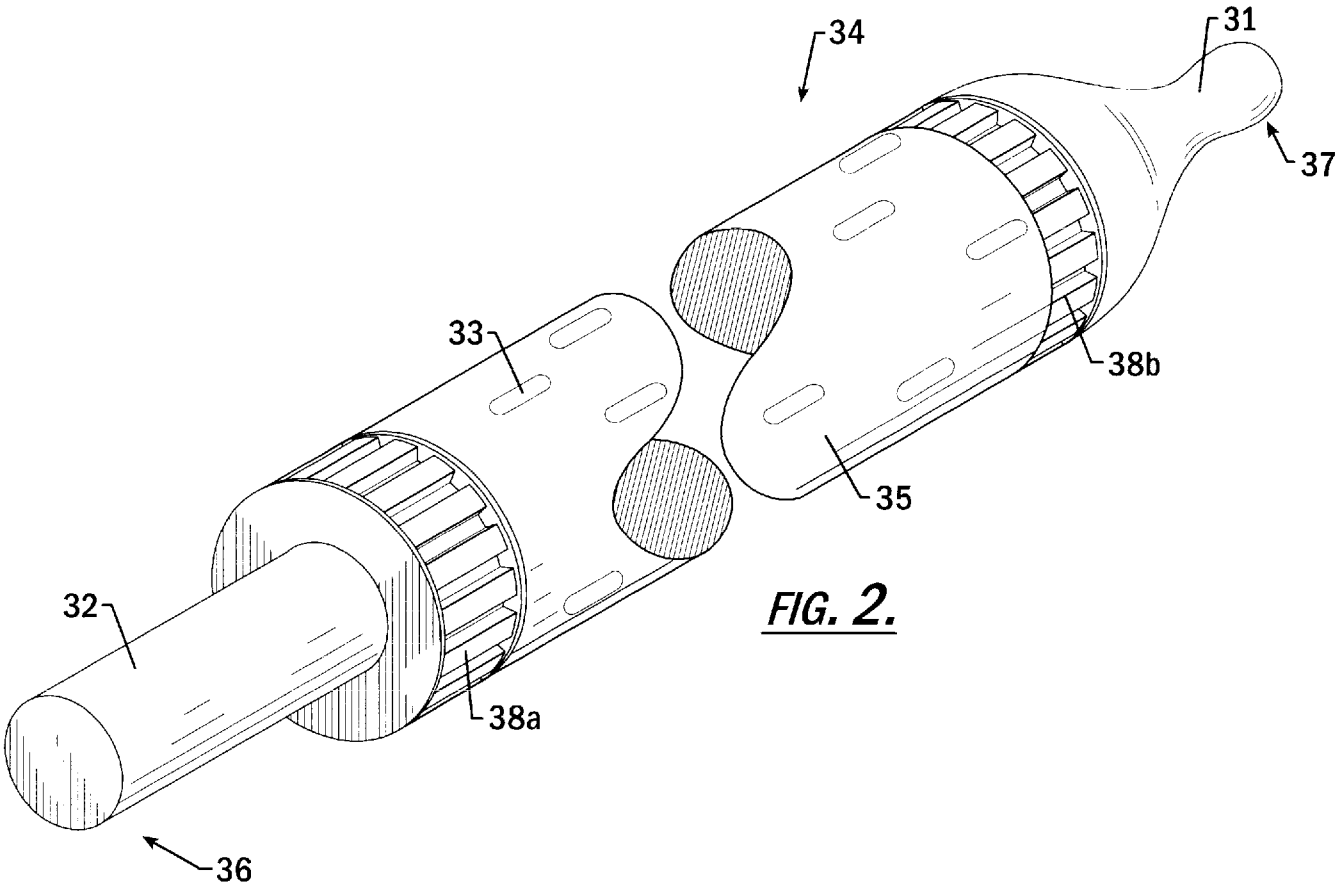
FIG. 2 shows a perspective view of a mandrel having a middle portion that is cut away.

In FIG. 2, a mandrel 34 as used in the invention is shown. The mandrel may have a handle 32 at a first end 36, and a bullet nose 31 at a second end 37. The outer surface 35 of the mandrel is adapted for receiving a core, and friction nubs 33 are provided on the outer surface 35. Drive teeth 38*a* and 38*b* are located on the first and second ends, respectively, of the mandrel 34. The drive teeth 38*a* and 38*b* are adapted to engage driving apparatus as further discussed below.

Figure 3:
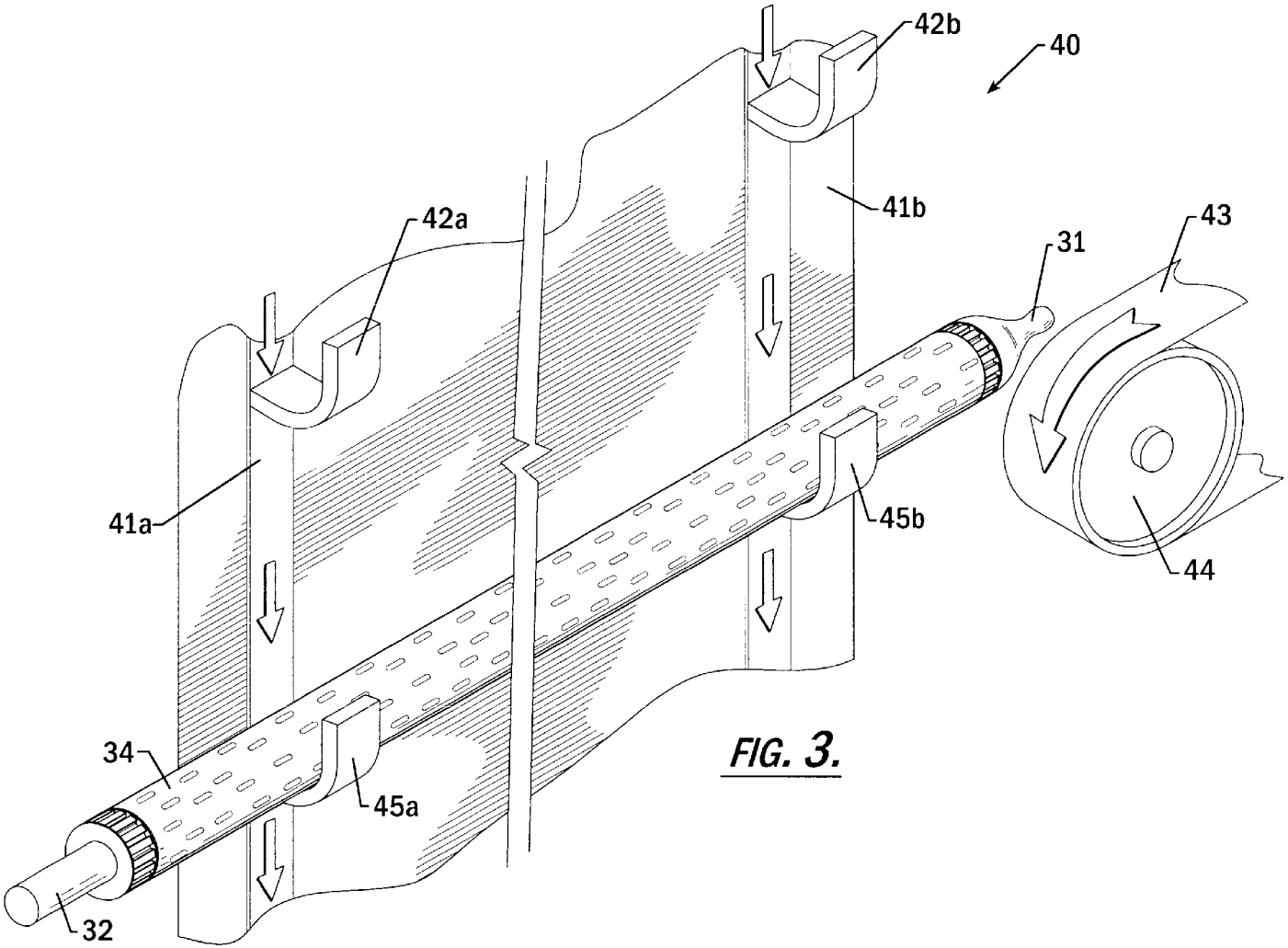
FIG. 3 depicts a mandrel loading station in which a mandrel is received from a conveyor and collected in a mandrel rack to be moved into position for further processing.

One example of a mandrel loading station 40 is shown in FIG. 3. Mandrel rack 41*a* and 41*b* move together to transport mandrels to another point in the process at which they receive cores on their outer surface. Retention hooks 42*a* and 42*b* are adapted to hold one mandrel, while another pair of retention hooks 45*a* and 45*b* are adapted to hold mandrel 34 as shown in FIG. 3. The mandrel 34 is provided along a moving conveyor means 43 and deposited upon retention hooks 45*a* and 45*b* for subsequent movement down the line. A driving means 44 is provided for conveyor means 43. The handle 32 is provided shown on the first end 36 of the mandrel 34.

Figure 4:
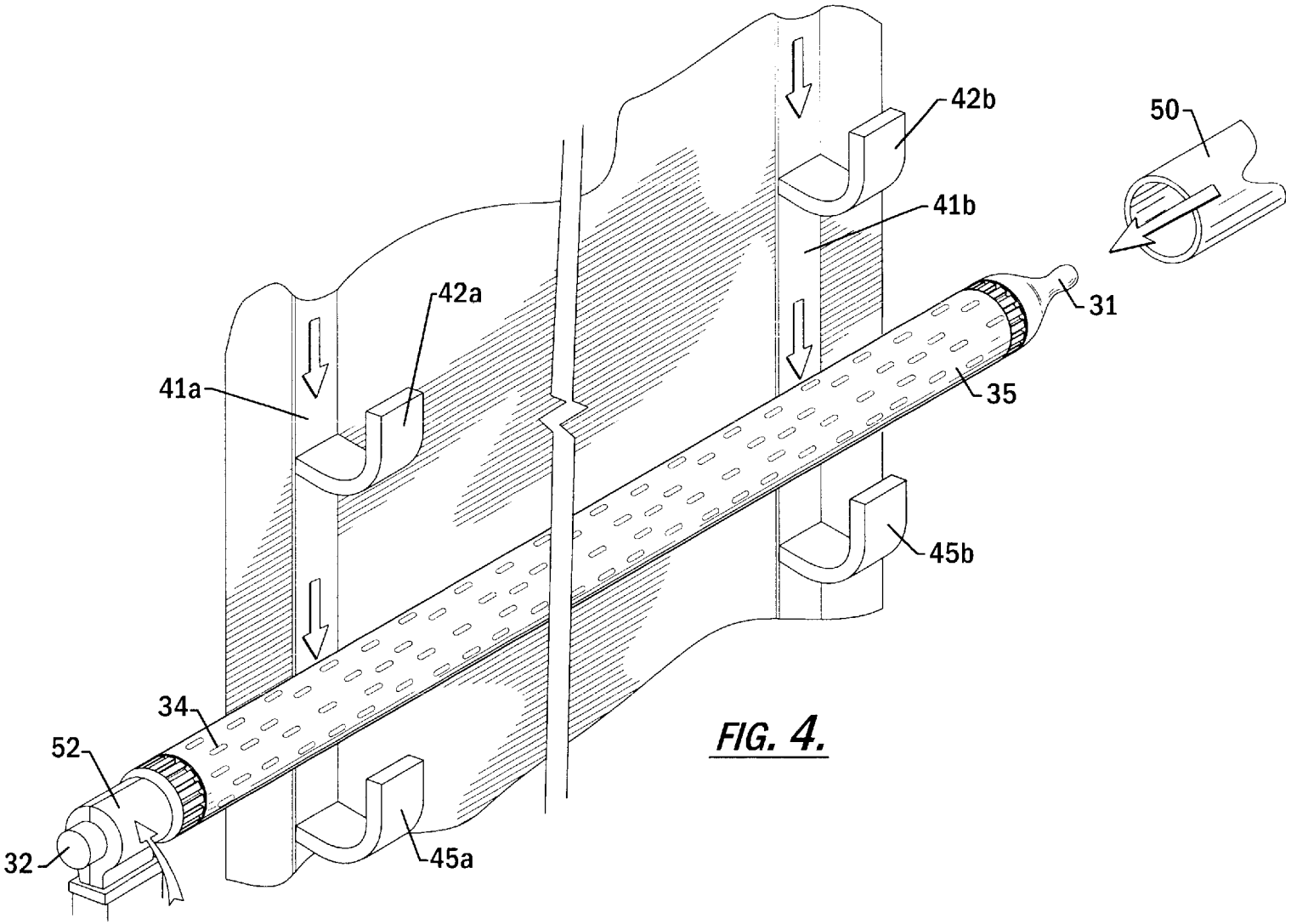
FIG. 4 shows a core loading station in which a mandrel is gripped by a gripping device, so a core may be loaded upon the outer surface of the mandrel.

FIG. 4 shows the mandrel 35 in which the handle 32 has been secured by a gripper 52 to enable a core 50 to be placed over the outer surface of the mandrel 34. The core 50 is placed upon the mandrel by the interaction of the bullet nose 31 with the core 50, whereby the bullet nose 31 helps guide the core 50 upon the outer surface 35 of the mandrel 34. Thus, the mandrel 34 is taken off of the pair of retention hooks 45*a* and 45*b* when it is gripped by the gripper 52, allowing the core 50 to slide upon the outer surface 35 of the mandrel 34. At this point, the outer surface 35 of the mandrel 34 is not in contact with the mandrel rack 41*a–b*.

Figure 5:
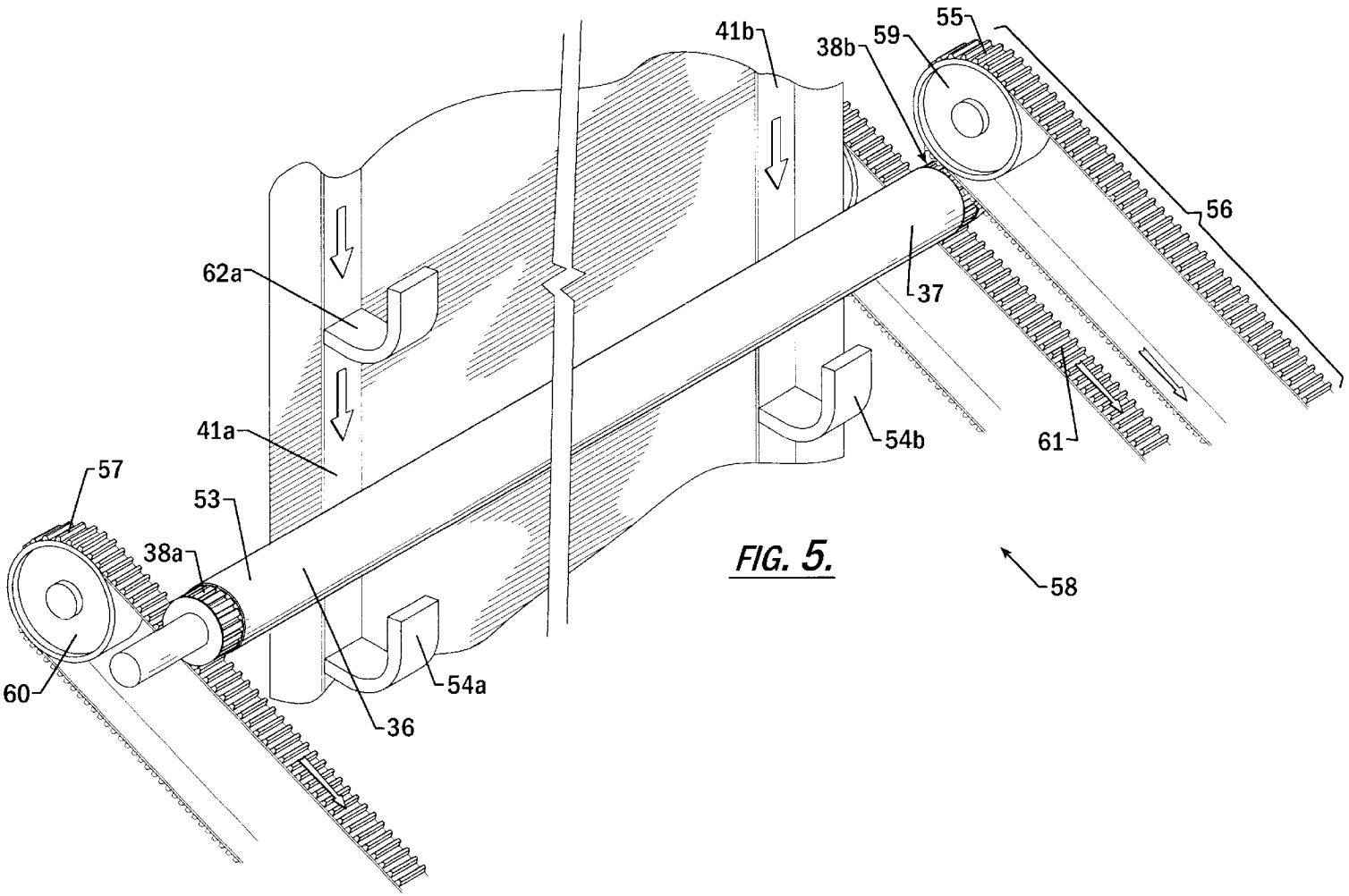
FIG. 5 shows a perspective view of a first conveyor which is capable of conveying a cored mandrel along a drive train.

In FIG. 5, a first conveyor 58 is shown in which a cored mandrel 53 has moved away from the mandrel racks 41*a* and 41*b* and is now engaged in a drive train 56 in which it will be moved towards a web transfer station, described below in connection with FIG. 9. The mandrel racks 41*a* and 41*b* shown in FIG. 5 has moved from its position in FIG. 4, so that a different set of retention hooks 54*a* and 54*b* have been moved along the line. The pulleys 59 and 60 drive belts 57 and 55 respectively. Hook 62*a* is seen in FIG. 5. Cored mandrel 53 is moved by the upper drive belt 55 and the lower drive belts 57 and 61 along the drive train 56. Thus, the cored mandrel 53 may be engaged at either the first end 36 or the second end 37 to move the cored mandrel 53 along a drive train 56.

Figure 6:
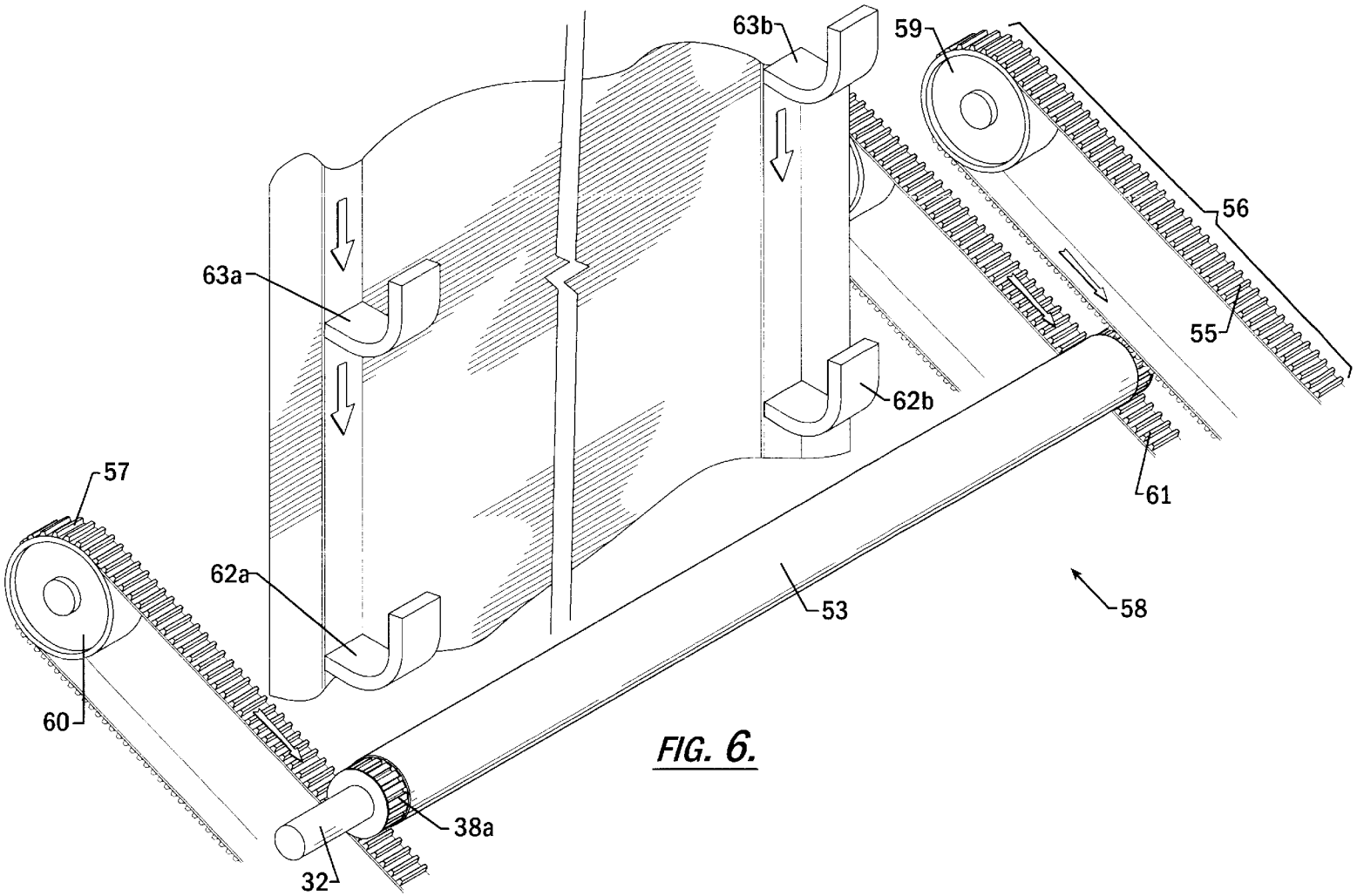
FIG. 6 shows another view of the first conveyor in which the cored mandrel has moved further down the line.

FIG. 6 provides a view of the first conveyor 58 which is shown in FIG. 5, except that the cored mandrel 53 has now moved further downstream in the process, i.e. further along the drive train. As compared to FIG. 5, the retaining hooks 62*a* and 62*b* have moved further along in their pathway, while at the same time the cored mandrel 53 has moved from a position near the pulley 59 and pulley 60, to a position further down the line, having been pushed along by action of the drive belts 55, 61, and 57. Retaining hooks 63*a* and 63*b* are seen near the top of the FIG. 6.

Figure 7:
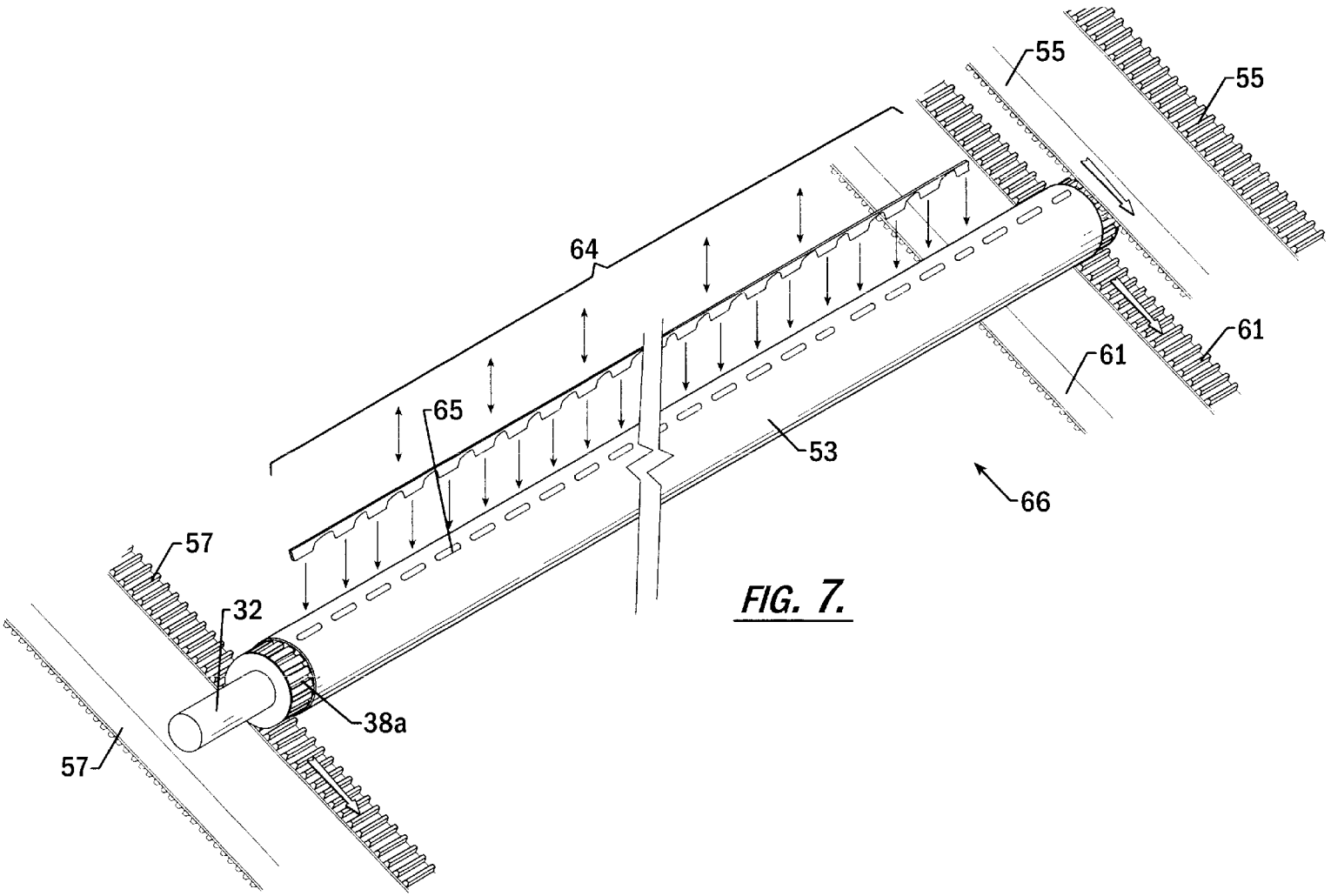
FIG. 7 is a perspective view of a mandrel which is moving along a first conveyor in a drive train, at an adhesive application station in which adhesive is applied to the outer surface of the core upon the mandrel.

In FIG. 7, an adhesive application station 66 is shown in which an applicator 64 provides adhesive 65 along the surface of the cored mandrel 53. For example, a cored mandrel 53 may be advanced by mechanical means into a section where a "transfer" or "pick up" adhesive 65 is applied to the core 50. The adhesive 65 is necessary to provide a location for the tissue or paper product to be glued or otherwise attached to the core 50, and then the paper may be wound upon the core 50. The glue or adhesive 65 may be applied either rotationally or axially in the practice of the invention. However, the speed of the overall process may be increased by applying glue axially along the length of the core 50. For example, prior art methods which applied glue to the entire exterior surface of the core, all the way around the circumference, tended to be wasteful and caused maintenance clean up problems due to excessive amounts of glue being thrown by centrifugal force upon the machinery during core rotation. The adhesive 65 may be applied in a solid line or a series of solid lines, or may be applied in an interrupted line as shown in FIG. 7. Only the amount of adhesive 65 actually needed to adhere paper to the core 50 is provided.

Figure 8:
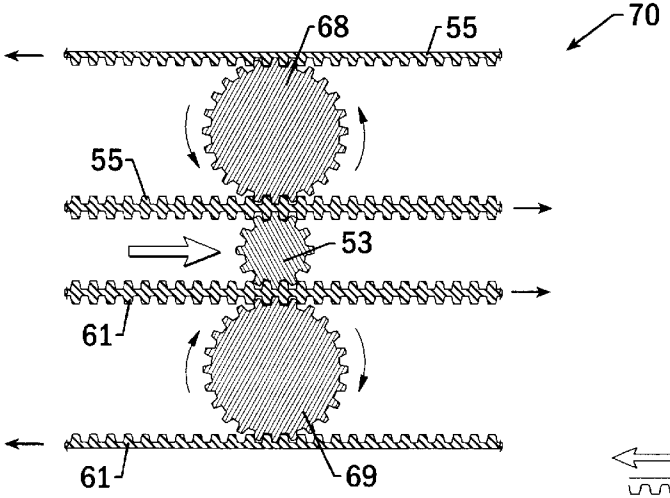
FIG. 8 is a cross-sectional view of a mandrel moving along a drive train.

FIG. 8 shows a cross-sectional view of the first conveyor 58 and drive train 56 shown in FIG. 7. For example, a drive train 70 is shown having a drive pulley 68, a drive pulley 69, and a cored mandrel 53 that is moved along from the left to the right as shown in FIG. 8. The upper drive belt 55 forms a continuous loop, in some applications. Furthermore, the lower drive belt 61 forms a continuous loop. The result of the counter clockwise rotations of upper drive belt 55 and lower drive belt 61 is that the cored mandrel 53 is rotated clockwise. The result of upper drive belt 55 moving at a faster speed than lower drive belt 61 is that cored mandrel 53 is moved from left to right in a precise timed sequence.

Figure 9:
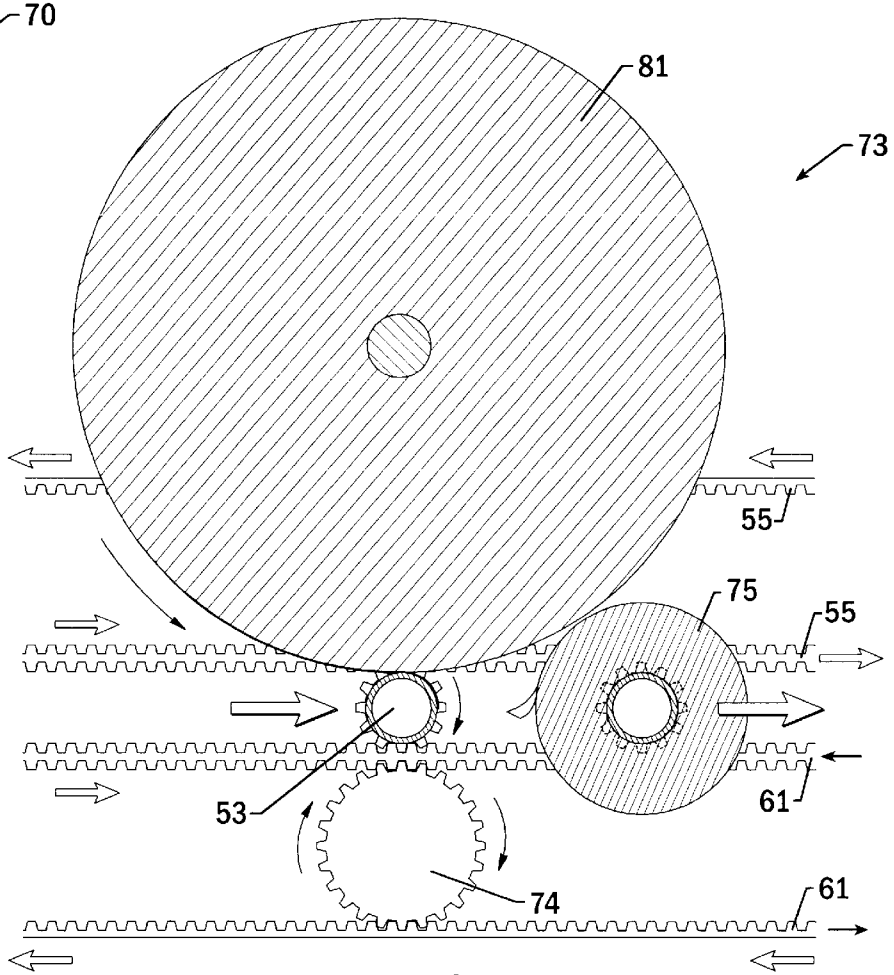
FIG. 9 shows a web transfer station in which a cored mandrel is placed in position for rewinding.

In FIG. 9, a web transfer station 73 is shown, and a moving web of paper is transferred from the existing bedroll 81 to a cored log 75 of webbed material. A cored mandrel 53 is brought into position from the left side as cored log 75 builds, to a point just below the bedroll 81. As the winding of the cored log 75 proceeds; the position of the cored mandrel 53 may change gradually by the same mean illustrated in FIG. 8 as the log diameter of the cored log 75 increases. A slight movement towards the right side of FIG. 9 may occur, to minimize web interference with machine components during winding. Then, when the desired length of webbed material has been wound upon a cored mandrel 53 into a finished cored log 75, the web is severed and transferred by the bedroll to another incoming cored mandrel (i.e. cored mandrel 53), and the process begins once again for each successive cored mandrel 53. In FIG. 9, drive belts 55 and 61 have a relationship independent of drive belts 56 and 62 in order to facilitate the difference in rotational value that is required. When the cored log 75 of webbed material is completed, it advances to the right and away of the vicinity of the web transfer station 73. The belt and pulley system of the invention is designed and timed specifically to accomplish the above stated objectives, and drive gear 74 powers the lower drive belt 61 in the direction shown in the FIG. 9.

In the practice of the invention, almost any mechanical device may be used to advance the cored mandrels 53 along the drive train 56 to form finished cored logs 75 of webbed or paper material.

Figure 10:
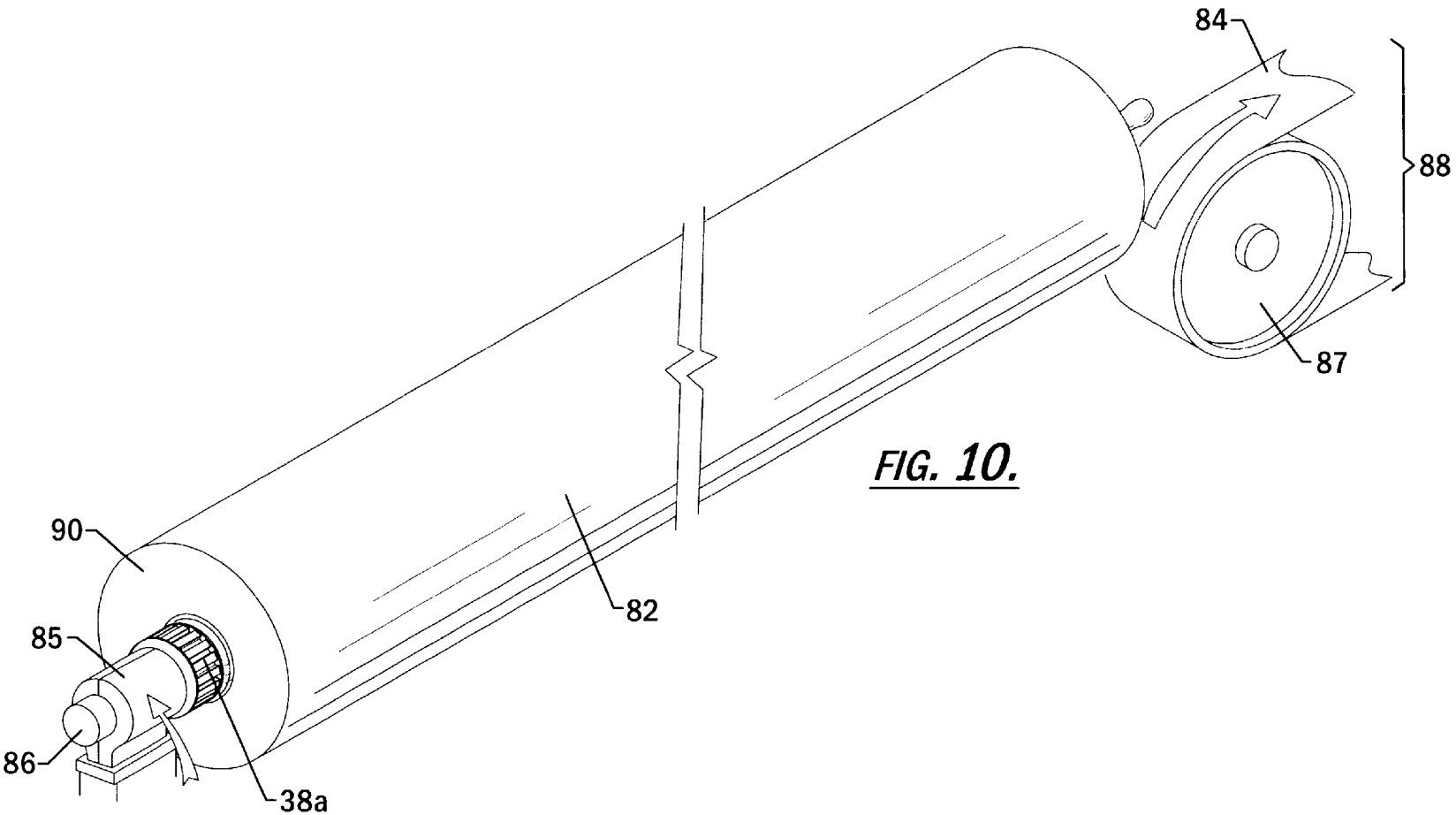
FIG. 10 is a perspective view of a webbed or paper log made pursuant to the invention which is being prepared for conveying from the mandrel transfer station to a log cutting area.

FIG. 10 shows a cored log 82 of webbed material which has been gripped by gripper 85 that attaches to the handle 86 of the mandrel at the first end 90 of the cored log 82. The cored log 82 is positioned for travel along conveyor 84, which is driven by drive 87. Drive 87 and conveyor 84 are independent of a mandrel return conveyor system 88 that is capable of returning mandrels 34 to a queue area once they have been stripped of their logs, to be reused again in the process. Once a cored log 82 is stripped from the mandrel 34 and forwarded to downstream processes for cutting and packaging, a bare mandrel is then returned to the queue area where it then awaits application of another core 50 to its outer surface. In some applications, the mandrels 34 will accumulate in the mandrel storage area, while in other applications mandrels 34 may be carried by a recycle loop back to a point at which they are reinserted into the manufacturing line of the rewinding process. In general, the processes and apparatus may be used for the rewinding of any web or paper material, including bath tissue, facial tissue, paper towels, or essentially any other rolled web product.

Furthermore, in other applications of the invention there exists the ability to change the sheet count per wound roll as the log builds, if mechanical and program capability of this type exists on the machinery employed. This real time adjustment of sheet count can be a significant advantage in the practice of the invention. In instances where a bedroll is not the primary means for severing and transferring the web, programming could be employed to allow single sheet count increments at the electronic command of a machine operator. Furthermore, it is possible to develop and/or vary winding profiles that are independent of the original winding profiles that are provided with converting machines, which is a significant advantage versus typically available machine technology. Mechanical drive relationships can be configured to alter the winding tensions throughout the building of a log in order to optimize log appearance per web material properties.

Web speeds which may be obtained in the practice of the invention are generally in excess of about 2500 feet per minute, sometimes as high as 3000 feet per minute or more. A roll speed of between about 2500 and 3500 feet per minute is very desirable.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A system for winding webbed material upon the core of a cored mandrel, comprising:

(a) an elongated mandrel, the mandrel being adapted to receive a core on its outer surface to form a cored mandrel, the mandrel having a first end and a second end, (b) a first conveyor for receiving and moving cored mandrels between a loading station and a transfer station, the first conveyor engaging at least the first end of each cored mandrel; and (c) wherein the transfer station is adapted to receive a roll of webbed material for being wound onto the cored mandrels on the first conveyor, the transfer station comprising a drive device positioned opposite the first conveyor, the drive device engaging the first end of the cored mandrels and rotating the mandrels for winding the webbed material onto the mandrels and forming logs.

2. The system of claim 1 in which the system further comprises: a gripping means, the gripping means being adapted to secure to the first end of the cored mandrel for removal of the cored mandrel from the first conveyor.

3. The system of claim 1 in which the system further comprises:

a log removal station wherein the logs are removed from said mandrels.

4. The system of claim 3 in which the system further comprises:

a second conveyor adapted to move mandrels from the log removal station to a mandrel retention area.

5. A system as defined in claim 1, wherein the drive device comprises a drive belt.

6. A system as defined in claim 5, wherein the drive belt comprises a continuous belt.

7. A system as defined in claim 1, wherein drive teeth are located at the first end of the cored mandrel, the drive teeth being engaged by the first conveyor and the drive device at the transfer station for rotating the mandrel.

8. A system as defined in claim 1, wherein each mandrel continues to move on the first conveyor as the mandrel is being rotated by the drive device.

9. A system as defined in claim 1, wherein the webbed material is only wound on the mandrel at the transfer station.

10. A system as defined in claim 1, wherein the loading station comprises a moving mandrel rack configured to hold and release mandrels onto the first conveyor.

11. A system as defined in claim 10, further comprising a core loading station for engaging mandrels on the moving mandrel rack and loading a core onto the mandrels.

12. A system as defined in claim 1, further comprising an adhesive application station positioned along the first conveyor between the loading station and the transfer station, the adhesive application station being configured to apply an adhesive to the cores on each cored mandrel for affixing a webbed material to the cores.

13. A system for winding webbed material upon cores in a continuous process, comprising:

a plurality of elongated mandrels, the mandrels being adapted to receive cylindrical cores on their outer surface, the mandrels each having a first end and a second end, the cores having a circumferential surface on their outer periphery;

a mandrel loading station adapted for receiving a plurality of individual mandrels and loading said mandrels with cores to form cored mandrels;

a first conveyor for receiving and moving cored mandrels from the mandrel loading station to a web transfer station, the first conveyor engaging at least the first end of each cored mandrel;

an adhesive application station positioned along the first conveyor between the mandrel loading station and the web transfer station, the adhesive application station being configured to apply an adhesive to the cores on each cored mandrel for affixing a webbed material to the cores; and wherein the transfer station is adapted to receive a roll of webbed material for being wound onto the cored mandrels on the first conveyor, the transfer station comprising a drive device positioned opposite the first conveyor, the drive device engaging the first end of the mandrels for winding the webbed material onto the mandrels and forming logs.

14. The system of claim 13 in which the web transfer station comprises a bedroll, the bedroll being configured to release the webbed material to a first cored mandrel once the first cored mandrel reaches a winding position, the webbed material being released by applying a driving force to at least the first end of said first cored mandrel, thereby pulling the webbed material from the bedroll and forming a cored log of webbed material while simultaneously holding in ready position a second cored mandrel, the second cored mandrel being pulled into the winding position by the first conveyor.

15. The system of claim 13 in which the cored mandrel comprises a friction gripping system on its outer surface.

16. The system of claim 15 in which the friction gripping system comprises a plurality of friction nubs on its exterior surface to securely grip the core.

17. The system of claim 13 in which the winding speed of the system at the web transfer station is at least about 2500 feet per minute.

18. The system of claim 13 in which the winding speed of the system at the web transfer station is at least about 2800 feet per minute.

19. The system of claim 13 in which the winding speed of the system at the web transfer station is at least about 3000 feet per minute.

20. The system of claim 13 in which the first end of said mandrel comprises teeth that are engaged by the drive device.

21. The system of claim 13 in which the second end of the mandrel is also engaged by the first conveyor.

22. The system of claim 13 in which the adhesive is placed longitudinally along the length of the cored mandrel at a specific circumferential location on the core.

23. A system as defined in claim 13, wherein the drive device comprises a drive belt.

24. A system as defined in claim 23, wherein the drive belt comprises a continuous belt.

25. A system as defined in claim 13, wherein each mandrel continues to move on the first conveyor as the mandrel is being rotated by the drive device.

26. A system as defined in claim 13, wherein the webbed material is only wound on the mandrel at the transfer station.

27. A system as defined in claim 13, wherein the loading station comprises a moving mandrel rack configured to hold and release mandrels onto the first conveyor.

28. A system as defined in claim 27, further comprising a core loading station for engaging mandrels on the moving mandrel rack and loading a core onto the mandrels.

29. A system as defined in claim 28, further comprising a gripper positioned at the core loading station, the gripper being adapted to engage an end of a mandrel on the moving mandrel rack for loading a core onto the mandrel.

30. A system for winding webbed material upon a core of the cored mandrel comprising:

a mandrel loading station comprising a moving mandrel rack, the mandrel rack comprising a plurality of retention devices for holding a corresponding plurality of mandrels;

a core loading station positioned along the moving mandrel rack, the core loading station being adapted to engage a mandrel on the moving mandrel rack and load a core onto the mandrel;

a first conveyor for receiving and moving cored mandrels between the mandrel loading station and a web transfer station;

an adhesive application station positioned along the first conveyor between the mandrel loading station and the web transfer station, the adhesive application station being configured to apply an adhesive to the cores on each cored mandrel for affixing a webbed material to the cores; and wherein the transfer station is adapted to receive a roll of webbed material for being wound onto the cored mandrels on the first conveyor, the transfer station comprising a drive device for rotating the mandrels and winding the webbed material onto the mandrels and forming logs.

31. A system as defined in claim 30, wherein the core loading station comprises a gripper that grips one end of a mandrel for loading a core on the mandrel.

32. A system as defined in claim 30, wherein the drive device at the transfer station is positioned opposite the first conveyor, the drive device and the first conveyor engaging opposite sides of a first end of the cored mandrels for rotating the mandrels.

33. A system as defined in claim 32, wherein the drive device comprises a drive belt.

34. A system as defined in claim 32, wherein drive teeth are located at the end of the cored mandrel, the drive teeth being engaged by the first conveyor and the drive device for rotating the mandrels.

* * * * *